United States Patent [19]

Spell

[11] 4,422,435

[45] Dec. 27, 1983

[54] PORTABLE CHARCOAL IGNITERS OR IGNITION SYSTEMS AND APPARATUS RELATING THERETO

[76] Inventor: William D. Spell, P.O. Box 1734, Eustis, Fla. 32726

[21] Appl. No.: 257,487

[22] Filed: Apr. 24, 1981

[51] Int. Cl.[3] ..... F24B 3/00

[52] U.S. Cl. ..... 126/25 B; 126/39 E; 126/41 R; 248/312; 248/318; 431/343

[58] Field of Search ..... 126/25 R, 25 A, 25 B, 126/41 R, 39 E; 431/343; 248/309 R, 311.2, 312, 318, 324; 44/34, 35

[56] References Cited

U.S. PATENT DOCUMENTS

| | | | |
|---|---|---|---|
| 2,879,761 | 3/1959 | Foster et al. | 126/40 |
| 3,033,275 | 5/1962 | Nichols | 126/25 R |
| 3,410,261 | 11/1968 | Cooper et al. | 126/25 B |
| 3,589,312 | 6/1971 | Cooper | 126/25 B |
| 3,605,653 | 9/1971 | Donnell | 126/25 B |
| 3,779,693 | 12/1973 | McKenney et al. | 126/25 B |
| 3,824,984 | 7/1974 | Swanson et al. | 126/25 R |
| 3,938,494 | 2/1976 | Clark | 126/25 R |

*Primary Examiner*—Samuel Scott
*Assistant Examiner*—Margaret A. Focarino
*Attorney, Agent, or Firm*—Robert L. Martin

[57] ABSTRACT

A charcoal briquette igniter for use with outdoor grills includes a pressurized fuel gas container and a burner which has a cage that surrounds the orifices to which the fuel gas issues from the burner. An airtight conduit innerconnects the burner and container so that the admixture of air and fuel transpires after the fuel gas has been discharged from the orifices, the cage under such circumstances being adapted to support the briquettes spacedly apart from the orifices and to define a compartment in which the air and combustible fuel gases mix and burn. The fuel container of the igniter is supported by a hanger that is in turn suspended from the wall of the grill brazier, the hanger being adapted to underlie a valve component that is secured to the container and to support the container at the side of the grill through its connection with the valve component.

2 Claims, 7 Drawing Figures

PORTABLE CHARCOAL IGNITERS OR IGNITION SYSTEMS AND APPARATUS RELATING THERETO

BACKGROUND OF THE INVENTION

The invention relates to portable charcoal briquette igniters or ignition systems that are used with portable outdoor grills using charcoal briquettes for fuel.

In the prior art there are generally two types of igniters that are used for igniting charcoal, namely those igniters in which the air is mixed with the pressurized gaseous fuel before the latter is discharged to a combustion zone, and those where the air is mixed with the pressurized gaseous fuel after it is discharged into the combustion zone. A typical example of the former type is illustrated in U.S. Pat. No. 3,605,653, while examples of the latter type are illustrated in U.S. Pat. Nos. 3,410,261 and 3,589,312.

Among the disadvantages associated with igniters which rely on the ignition of a pressurized gaseous fuel that has been premixed with air is that the igniters are more expensive to manufacture and hence more costly to the purchasing public for reasons, among others, that such igniters require many additional interfitting parts in order to facilitate the mixing of the air and fuel before its issuance into the combustion zone. Additionally, the orifices through which the mixture is discharged to the combustion zone often become clogged with debris through neglect and this results in a tendency for the pressurized gaseous fuel to back up and pass outwardly through the air intake sytem. This occasionally results in a flashback through the air intake system and which is, of course, dangerous to anyone in the vicinity of the igniter.

The ignition systems which fail to provide for mixing of the air and gaseous fuel before its issuance into the combustion zone also have disadvantages. For one, when the gaseous discharge orifices are located deep in a pile of charcoal briquettes, there is often insufficient opportunity for the air and gas to adequately mix before it reaches the peripheral regions of the pile of charcoal briquettes. As such, combustion primarily takes place in the peripheral regions of the charcoal pile and the center region of the pile becomes ignited thereafter. This results in an excess of fuel consumption by the ignition system and often a nonuniformly ignited pile of charcoal briquettes when the igniter is removed. Regardless of the type ignition encountered there is the ever present problem of providing an ignition that can be safely handled and also adapted for use with portable charcoal grills of varying sizes and designs.

SUMMARY OF THE INVENTION

In accord with the invention, the inventor provides a cage that supports the charcoal briquettes in a pile being ignited spacedly apart from the gaseous fuel discharge orifices of the burner. The cage provides a zone about the discharge orifices for the gaseous fuel in which the air and gaseous fuel are mixed and the combustion transpires. The cage is attached to and supports the orifice forming fuel gas discharge passageways spacedly apart from the supporting surface for the cage so that air can pass between the briquettes and into the combustion zone along the supporting surface for the cage. In the preferred practice, the gas discharge passageways are so arranged that the gaseous fuel passing through the orifices is directed away from the supporting surface so as to provide a reduced pressure above the surface and which draws the air into the combustion zone along the supporting surface for the burner structure.

A general object of the invention is to provide an improved ignition system for igniting pulled charcoal briquettes. Yet another object is to provide an improved portable igniter for use with outdoor barbecue grills. Still another objective is to provide an igniter that facilitates the initial ignition of the charcoal briquettes in the center of a pile thereof. Yet another object is to provide a portable ignition system which can be readily adapted for use with an outdoor grill for igniting charcoal briquettes and which can be quickly and safely removed when it has served its intended purpose. Yet another objective is to provide an item of the kind contemplated and which is relatively inexpensive to manufacture but which is nevertheless entirely satisfactory for its intended use. Another objective is to provide an igniter which is safe to use and inexpensive to manufacture. Yet another objective is to provide an igniter which is portable and which does not require modifications to the grill in order to be used therewith and in particular one which avoids the necessity for drilling holes or providing cutouts in the grill structure to facilitate its use. Still another objective is to provide an ignition system which involves a pressurized gaseous fuel container and a burner that is safe and easy to manipulate by simply grasping the container with one hand in order to place the igniter in position for use as well as to remove it from the grill after it has performed its intended purpose.

BRIEF DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

DESCRIPTION OF PREFERRED EMBODIMENT

Figure 1:
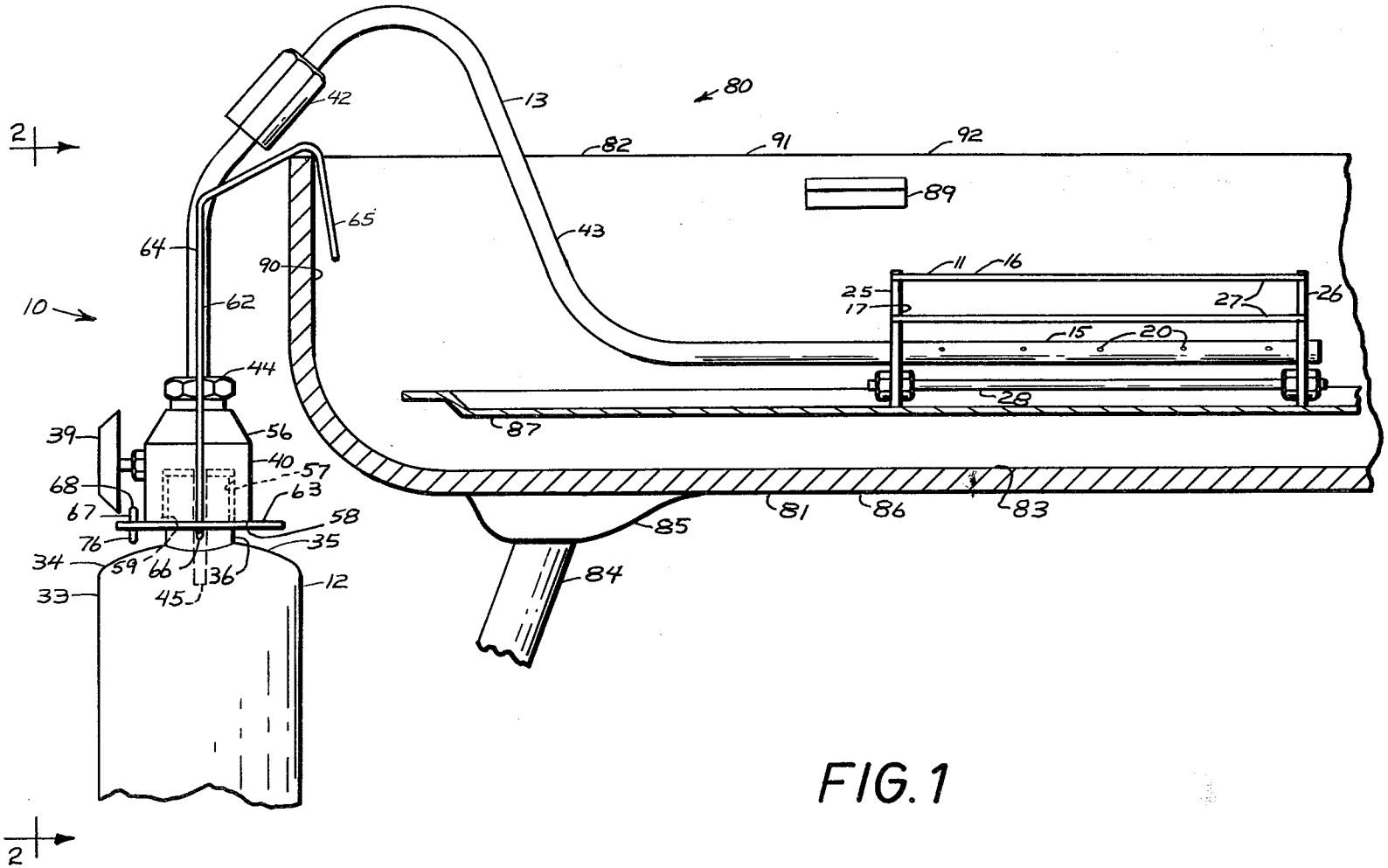
FIG. 1 is a side elevational view of an embodiment of the invention as seen when supported on the brazier of a portable outdoor grill, the grill being fragmented and shown in vertical section and with certain parts of the embodiment being broken away.
Figure 3:
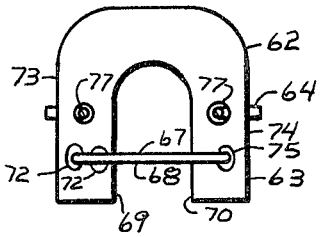
FIG. 3 is a horizontal sectional view along the Lines 3—3 of FIG. 2 with the valve component and gaseous fuel container removed so as to better illustrate the structure of the U-shaped member or component of a hanger that is used in suspending the container from the brazier.
Figure 7:
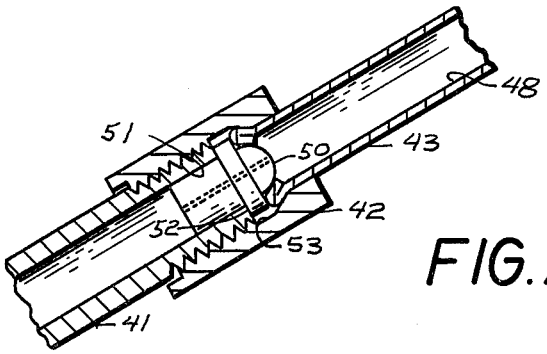
FIG. 7 is a fragment showing an orifice member that is used in the conduit interconnecting the gaseouse fuel container and the burner therefor.
Figure 2:
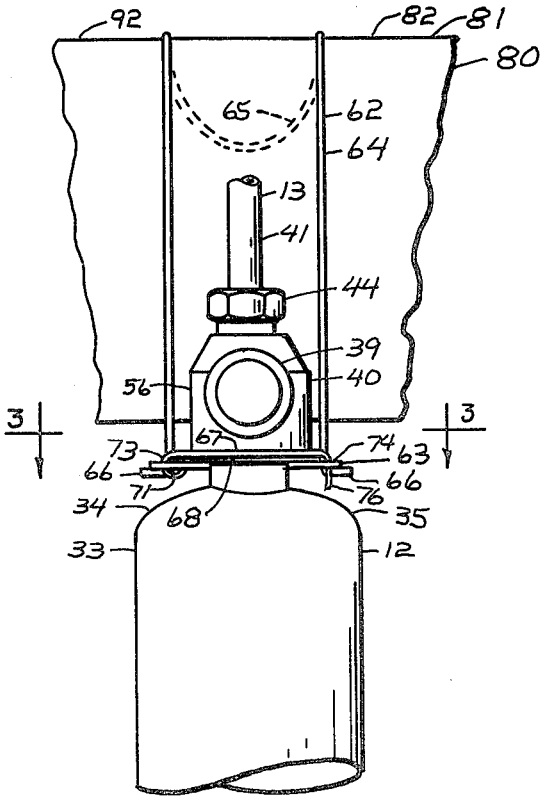
FIG. 2 is a side elevational view taken generally along the Lines 2—2 of FIG. 1, with certain parts broken away.
Figure 4:
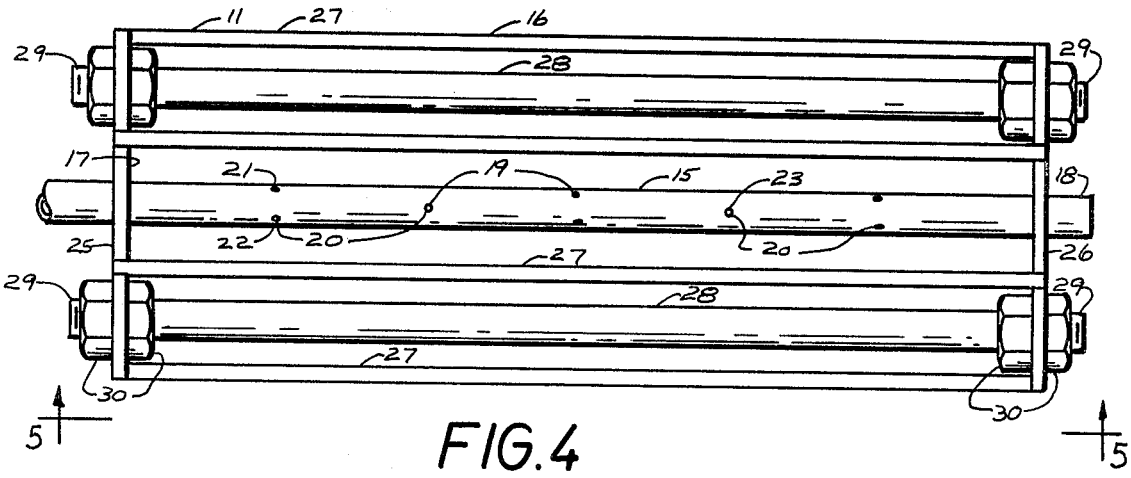
FIG. 4 is a top plan view of the gaseous fuel burner component of the ignition system or igniter.
Figure 5:
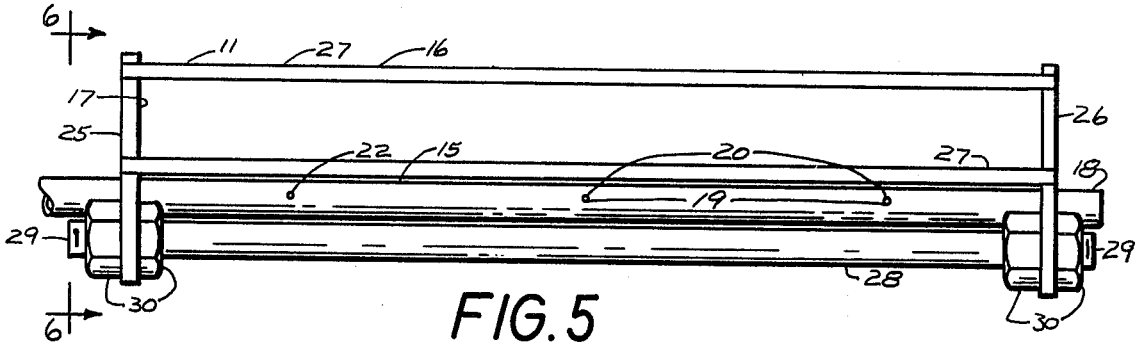
FIG. 5 is a side elevational view of the burner component as seen generally along the Lines 5—5 of FIG. 4.

Reference is now made to the drawings and wherein a portable charcoal briquette igniter or ignition system is designated at 10. The igniter includes a burner 11, a pressurized gaseous fuel container such as a propane tank 12, and a conduit 13 which interconnects the container 12 and burner 11 and provides a means for delivering the pressurized gaseous fuel to the burner.

The burner 11 includes an elongated, linearly extending tube section 15 and a cage 16 that is fixed to and supports the tube section spacedly above the supporting surface for the cage. The tube section 15 is closed by a plug (not shown) at one end 18 and has a plurality of laterally opening passageways 19 that form the gaseous fuel discharge orifices 20 of the burner. The passageways 19 are arranged along opposite side rows 21 and 22 and along a top row 23 in the structure of the tube section 15. The axes of the orifices in the side rows 21 and 22 are preferably inclined to the horizontally supporting surface for the cage to avoid interference with air movement along the supporting surface and into the air mixing and combustion zone 17 defined by the cage structure about the tube section 15.

The burner cage 16 includes a pair of flat, generally semicircular end pieces 25 and 26 that are spaced apart and interconnected by a plurality of laterally spaced apart and linearly extending elongted metal elements 27 that are arranged in parallel with and laterally offset from the burner tube 15. These elements 27 are fixed at their opposite ends, as by brazing to the arcuate edges of the end pieces 25 and 26 as generally illustrated in the drawings. At the bottom of the cage 16, the end pieces 25 and 26 are interconnected by a pair of horizontally spaced apart rods 28. Here the end pieces 25 and 26 are provided with aligned openings (not shown) through which the opposite ends 29 of the rods extend. These ends 29 are threaded and the end pieces are secured to the rods by being clamped between a pair of nuts 30 that threadingly engage such ends 29.

The end pieces 25 and 26 of the cage are arranged in parallel in the cage structure and each assumes an upright position as seen in the drawings when the cage is supported on the supporting surface for the burner. The end pieces 25 and 26 also have aligned openings (not shown) through which the linear tube section 15 of the burner extends. Here, the tube section 15 is also fixed to the end pieces 25 and 26, as by brazing, or other suitable means.

The gaseous fuel container 12 is of a conventional construction used to contain pressurized gaseous fuels and includes a cylindrical metal side wall 33 that in the illustration is joined to a bottom wall forming piece (not shown) at the lower end of the container 12. At the upper end 34 of the container, the side wall 33 has an end portion 35 which is formed and shaped to provide a shoulder that is joined to a neck piece 36 which extends upwardly from shoulder forming end portion 35. This neck piece 36 is threaded to facilitate the mounting of a valve component of the conduit 13 interconnecting the burner 11 and container 12 as will be subsequently seen.

The conduit 13 connecting the gaseous fuel container 12 and burner 11 includes the valve component 40 that is securedly mounted on the neck piece 36 of the container 12. The valve component 40 is connected by a fitting 44 to a rigid discharge pipe 41 that is coupled by a female coupling 42 engaging threads at the end of pipe 41 to an elongated tubular section 43 that constitutes an integrally connected extension of the burner tube section 15.

The valve 40 is equipped with a bayonet-type intake pipe 45 that extends through a conventional elastomeric seal (not shown) which serves to retain the gaseous fuel contents in the container in the absence of such an intake pipe. The intake pipe 45, valve component 40, discharge pipe 41, tube section 43, and tube section 15 provide an air tight passageway 48 that extends between the interior 49 of the fuel container 12 and the discharge orifices 20 of the burner 11. As such, the mixture of the gaseous fuel and air for supporting the combustion of the fuel transpires after the gaseous fuel has discharged from the orifices 20.

The valve component 40 has a control knob 39 for opening and closing the valve and thus for opening and closing the passageway 48 between the container 12 and burner orifice 20. Between the valve component 40 and burner 11, the passageway 48 is equipped with an orifice forming element 50 that serves to establish the maximum flow rate of gaseous fuel to the burner orifices 20. Element 50 fits in the open end 51 of the discharge pipe 41 and has a shoulder 52 that limits its upstream movement in the assembly. The female coupling 42 threadingly engaging the threaded end of the discharge pipe 41 has a socket 53 in which the shoulder forming end of the orifice element 50 is received. As such, downstream movement of the orifice element 50 is limited by contact with the coupling 42.

The valve component 40 has an outer casing 56 which is provided with a threaded end socket 57 in which the neck piece 36 is threadingly engaged and secured to the valve component 40. The casing 56 has an annular lower edge 58 that is arranged in a plane and surrounds the neck piece 36 at the mouth 59 of the socket 57. This annular edge 58 is spacedly offset from the shoulder forming end portion 35 of the container side wall 33 so as to facilitate the suspension and support of the container 12 through the valve component attached to the neck piece 36, as will be subsequently seen.

The container 12 is suspended from the grill by means of a hanger that is designated at 62. It includes a flat U-shaped metal member 63 which is adapted and arranged to straddle the container neck piece 36 and to underlie the annular lower edge 58 of the valve casing 56 in the space between the valve casing and the shoulder forming end portion 35 of the container. This permits the container 12 to be supported through the attached valve component 40. The flat U-shaped member 63 is connected to an elongated metal suspension element 64 that is bent to provide a hook 65 intermediate its opposite ends 66 so as to facilitate its suspension from the side wall of a grill brazier.

To prevent the yoke type member 63 from slipping out from under the valve component 40 when in use, the member 63 is equipped with a keeper 67 in the form of an elongated element 68 that is adapted for pivotal movement between open and closed positions at the mouth 69 of the slot 70 in the U-shaped member. The element 68 is provided with a looped end portion 71 that passes through a pair of spaced holes 72 in one leg 73 of member 63. This provides a loose pivotal connection facilitating limited movement of the keeper 67 about a pivot axis that is generally parallel to and in the plane of the leg 73. The other leg 74 of the yoke type member 63 is provided with an opening 75 for reception of a bent end portion 76 of the element 68 when the keeper is moved to the closed position to retain the member 63 about the neck piece 36 of container 12.

The connection between the yoke member 63 and the suspension element 64 also permits limited relative pivotal movement between the connected parts. Such movements permits a flush relationship to be attained between the surface of the yoke member 63 and the annular lower edge 58 of the outer casing 56 of the valve when the container is suspended from the hanger. As seen in the drawings, the yoke member 63 has a pair of holes 77 that are located in the respective legs 73 and 74 for reception of the opposite end portions 66 of the suspension element 64. These end portions 66 extend through the respective holes 77 and are bent to underlie the legs 73 and 74 in a laterally projecting aligned arrangement that permits limited pivotal movement of the yoke member 63 with respect to the suspension element 64 about a horizontal axis that is generally normal to the axis of the slot 70 between the yoke.

The benefits and advantages of the invention will be apparent from a consideration of the use of the igniter with a grill such as illustrated at 80 in the drawings. As seen therein, the grill has a stamped metal brazier 81 that is provided with an upright cylindrical side wall 82 that surrounds the fuel burning compartment 83. The grill 80 is of a conventional design found in the marketplace and has legs 84 that are secured to the underside of the brazier 81 by suitable brackets 85 which are welded to the bottom 86 of the brazier. The brazier 81 is thus suitably supported spaced above the ground by the legs 84 and the legs, of course, may be of the type that are equipped with ground contacting wheels at their lower ends. The brazier 81 is equipped with suitably spaced lugs 89 at the interior side 90 of the upright side wall 82. These are provided for supporting a wire grill (not shown) in the upper opening 91 of the brazier. Internally, the brazier 81 is equipped with an adjustable fire pan 87 to contain and support the solid fuel. The pane 87 may be elevated to selected positions by suitable means (not shown). The invention may be used, of course, with other grills, the one shown being merely illustrative of one such grill with which the igniter may be used.

When the igniter 10 is placed in use, the fire pan 87 of the brazier 81 is preferably lowered to its lowermost position and the hook end of the container hanger 62 is hooked over the upper edge 92 of the upright side wall 82 of the brazier. The components of conduit 13 are resistant to flexing but the tube section 43, although resistant to flexing, is nevertheless bendable so that prior to initial use of the igniter 10 with the grill 80, the tube section 43 may be bent and formed so that it rises above the side wall 82 of the brazier 81 to its connection with the discharge pipe 41 when the burner 11 is resting on the supporting surface provided by the pan 87 and the fuel container is appropriately suspended externally of the burner compartment 83 and from the side wall 82 by means of the hanger 62. The bendable nature of tube section 43 permits the igniter to be adapted for use with a particular grill while the resistance to flexing of the section 43 generally maintains the burner and container relatively fixed so that the whole igniter assembly can be manipulated into its position of use with the hanger 62 attached to the neck of the container by simply grasping the container with one hand and manipulating the hook 65 over the edge of the brazier wall.

Figure 6:
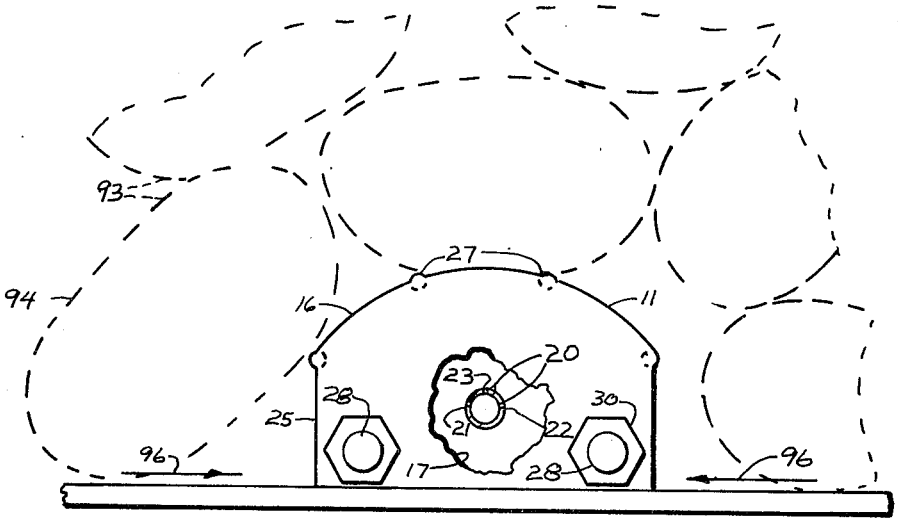
FIG. 6 is an end view of the burner as seen generally along the Lines 6—6 of FIG. 5, a pile of charcoal briquettes being generally illustrated in broken lines.

With the container 12 properly suspended from the side wall 82 at the exterior of the compartment 83 and with the burner 11 supported on the pan 87, charcoal briquettes 93 may be heaped about the cage to provide a pile 94 of the briquettes that are supported spacedly apart from the discharge orifices 90 by the cage, as illustrated in FIG. 6. With the briquettes thus oriented, the control knob 39 may be manipulated to pass pressurized gaseous fuel to the burner orifices 20. The cage 16 defines an air mixing and combustion zone 95 about the burner tube 15 and wherein the pressurized gaseous fuel issuing from the orifices 20 is able to mix with air and become ignited at the base of the charcoal pile 94. By avoiding orifices that are directed downwardly toward the supporting surface provided by the pan 87, air is capable of passing into the zone 95 between the briquettes along the upper surface of the pan, as illustrated by arrows 96 in FIG. 6. The spaced arrangement of the orifice containing tube section 15 above the supporting surface and the inclination of the orifices 20 in the side rows 21 and 22 provide a slightly reduced pressure condition above the pan that draws the air inwardly along the burner supporting surface of the pan so that both air mixing and combustion occurs in zone 95.

Once the briquettes are suitably ignited, the igniter 10 may be safely and simply removed from the grill 93. Since the burner 15 remains relatively fixed with respect to the container 12 for reasons of the resistance of the conduit components to flexing, the valve component may be manipulated to close the passageway 48 and the igniter 10 then removed from the grill by simply grasping the container 12 with one hand to dislodge the hook from the side wall of the brazier. This removal of the igniter from the brazier can be accomplished without danger that the high temperature burner will inadvertently swing into contact with the person manipulating the igniter as occasionally happens when the conduit connecting the pressurized gaseous fuel container and the burner includes a flexible component.

The orifice element 50 is used in the passageway 48 so as to establish the maximum flow rate of fuel to the discharge orifices and to thereby avoid pressures which would be so forceful at the orifices as to preclude adequate mixing of the air and gaseous fuel within the combustion zone 95.

The pivotal arrangement used to couple the hanger parts together has certain advantages. For one, the pivotal arrangement enables the flat yoke to pivot into full surface contact with the plane annular edge 58 of the casing 56 when the container 12 is suspended from the yoke member 63 through the casing. Secondly, the connection provided is simple and inexpensive to provide in the manufacturing process.

It will also been seen that providing an air tight passageway between the pressurized gaseous fuel container and the burner discharge orifices that opportunity for flashback within the conduit is avoided.

While only a certain preferred embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. In a portable charcoal briquette ignition system having a pressurized gaseous fuel container, a burner with a plurality of gas discharge orifices, and conduit means interconnecting the burner and gaseous fuel container for delivering the gaseous fuel to said burner, the improvement wherein said burner includes means forming said plurality of gas discharge orifices, and a metal cage that is fixed to the orifice forming means and thereabout defines a zone for the combustion of gaseous fuel discharged from the orifices, said cage is adapted and arranged to rest on an underlying support surface and to support the briquettes in a pile of charcoal briquettes heaped about the cage spacedly apart from said discharge orifices, said conduit means and orifice forming means provides an air tight passageway between said fuel container and said orifices whereby the admixture of air with gaseous fuel burned at said burner transpires in said combustion zone, said orifice forming means is an elongated, linearly extending metal tube section, said cage comprises elongated, linearly extending metal elements that are laterally offset from and fixed in parallel with said tube section, said conduit means has a valve component that is secured to said container and manipulatable to control the flow of gaseous fuel into said air tight passageway, and wherein said improvement further comprises a hanger for suspending the container from the side wall of a brazier, said gaseous fuel container having a shoulder forming end portion, and a neck piece extending upwardly from said shoulder, said valve component being secured to said neck piece and having an outer casing with a socket in which the neck piece is received, and an annular lower edge that is spaced apart from the shoulder and surrounds the neck piece at the mouth of the socket, said hanger having a flat U-shaped member which is adapted and arranged to straddle the neck piece and underlie the annular lower edge between the outer casing and the shoulder, thereby to support the container through the valve component secured to the neck piece thereof, and means engagable with the side wall of a brazier and connected to said member for suspending said member and the container supported thereby from said side wall.

2. In a portable charcoal briquette ignition system having a pressurized gaseous fuel container, a burner with a plurality of gas discharge orifices, and conduit means interconnecting the burner and gaseous fuel container for delivering the gaseous fuel to said burner, the improvement in accord with claim 1 wherein said side wall engagable means is pivotally connected to said member.

* * * * *